US006948827B2

(12) United States Patent
Tally

(10) Patent No.: US 6,948,827 B2
(45) Date of Patent: Sep. 27, 2005

(54) LED FLASHLIGHT CONSTRUCTION

(75) Inventor: Kevin L. Tally, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 10/714,485

(22) Filed: Nov. 14, 2003

(65) Prior Publication Data

US 2005/0105287 A1 May 19, 2005

(51) Int. Cl.[7] ..... F21L 4/00
(52) U.S. Cl. ..... 362/196; 362/118; 362/208
(58) Field of Search ..... 362/196–208, 362/118–120, 113, 114; 862/555, 800

(56) References Cited

U.S. PATENT DOCUMENTS

| | | | | | |
|---|---|---|---|---|---|
| 3,737,650 | A | * | 6/1973 | Kaye et al. | 362/191 |
| 4,223,521 | A | * | 9/1980 | Saitoh et al. | 368/204 |
| 4,777,582 | A | | 10/1988 | Sharrah | |
| 4,888,670 | A | | 12/1989 | Sharrah | |
| 5,158,356 | A | * | 10/1992 | Guthrie | 362/188 |
| 5,335,150 | A | * | 8/1994 | Huang | 362/118 |
| 5,601,359 | A | | 2/1997 | Sharrah et al. | |
| D380,858 | S | | 7/1997 | Sharrah et al. | |
| D381,812 | S | | 8/1997 | Sharrah et al. | |
| 5,663,828 | A | * | 9/1997 | Knowles et al. | 359/237 |
| 5,674,000 | A | | 10/1997 | Kalley | |
| 5,742,066 | A | | 4/1998 | Cavestri | |
| 5,788,364 | A | | 8/1998 | Cooper et al. | |
| 5,791,766 | A | * | 8/1998 | Lee | 362/259 |
| D409,777 | S | | 5/1999 | Sharrah et al. | |
| 5,959,306 | A | | 9/1999 | Kalley et al. | |
| 5,975,712 | A | | 11/1999 | Shiao | |
| 6,056,415 | A | * | 5/2000 | Allred et al. | 362/202 |
| D427,347 | S | | 6/2000 | Sharrah et al. | |
| D427,702 | S | | 7/2000 | Sharrah et al. | |
| D430,321 | S | | 8/2000 | Sharrah | |
| 6,200,134 | B1 | | 3/2001 | Kovac et al. | |
| D445,928 | S | | 7/2001 | Sharrah et al. | |
| 6,299,323 | B1 | * | 10/2001 | Yu et al. | 362/116 |
| 6,305,832 | B1 | * | 10/2001 | Huang | 366/129 |
| D452,024 | S | | 12/2001 | Sharrah | |
| 6,355,935 | B1 | | 3/2002 | Kalley et al. | |
| 6,402,340 | B1 | | 6/2002 | Sharrah et al. | |
| 6,491,408 | B1 | | 12/2002 | Cooper et al. | |
| 6,502,587 | B1 | * | 1/2003 | Kellum et al. | 132/301 |
| 6,523,973 | B2 | * | 2/2003 | Galli | 362/200 |
| 2003/0137833 | A1 | * | 7/2003 | Hsu | 362/196 |
| 2003/0142489 | A1 | * | 7/2003 | Cooper et al. | 362/109 |

OTHER PUBLICATIONS

Professional Tool & Equipment Distributor, Apr. 2003, vol. 11, #2, p. 9, Stylus Reach LED flashlight.
Http://www.uview.com/What_s_New/body_what_s_new.html, Apr. 9, 2003, #413050, Flex–Lite.
Http://www.mastercool.com/press_releases.html, Apr. 9, 2003, #53512, Flex 'n Glow Mini UV Light.
Http://www.mastercool.com/homepage.html, Apr. 9, 2003, #53515, Mach IV Flexible Quad UV Light.

* cited by examiner

*Primary Examiner*—Stephen Husar
*Assistant Examiner*—Jason Han
(74) *Attorney, Agent, or Firm*—Banner & Witcoff, Ltd.

(57) ABSTRACT

An LED flashlight construction is formed from molded plastic housing members joined to provide a tubular section connected to a battery chamber capable of holding one or more disc batteries capable of providing adequate voltage for operating a light emitting diode positioned at the distal end of the tubular section. A conductive metal pocket clip may be elastically deformed for closure of the circuit to provide power to the light emitting diode.

16 Claims, 5 Drawing Sheets

FIG.2A
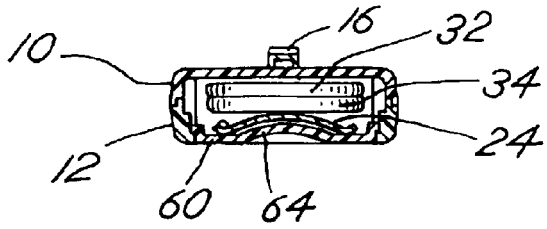
FIG.2B
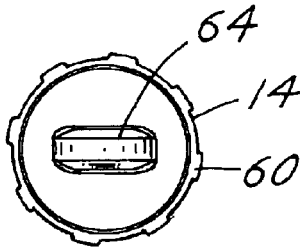
FIG.2C
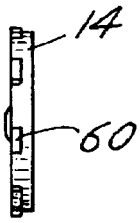
FIG.2D
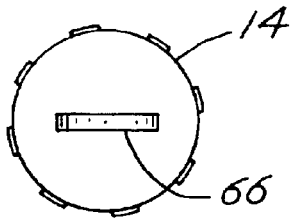
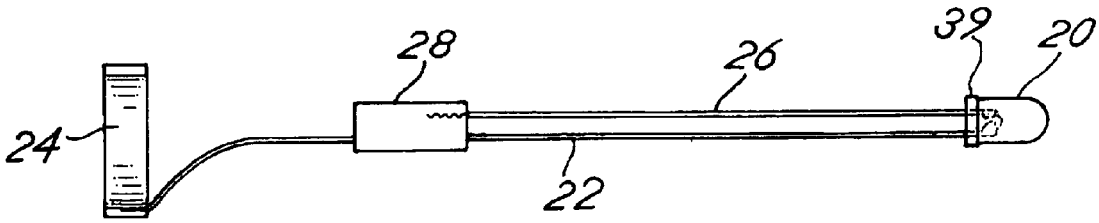
FIG.11

LED FLASHLIGHT CONSTRUCTION

BACKGROUND OF THE INVENTION

In a principal aspect the present invention relates to a flashlight comprised of a light emitting diode (LED) light source mounted in a housing and powered by one or more disc shaped batteries of sufficient voltage. The flashlight includes a pocket clip which may be elastically deformed to complete or close the circuit to activate the light source.

The light source may have a selected wave length, for example, an infrared, ultraviolet or white light emitting diode. The choice of the light source enables the user of the flashlight to utilize the light for detecting materials that are reactive to infrared or ultraviolet radiation, for example.

There are numerous patents directed to the construction of flashlights wherein the light emitting diode light source is utilized as a means to detect fluid leakage, for example. Among the various patents directed to such light constructions are the following:

| U.S. Pat. No. | Title | Issue Date |
|---|---|---|
| 5,674,000 | Light Source For Use In Leak Detection In Heating, Ventilating and Air Conditioning Systems That Utilize Environmentally-Safe Materials | Oct. 7, 1997 |
| 5,742,066 | Light Source For Use In Leak Detection In Heating, Ventilating and Air Conditioning Systems That Utilize Environmentally-Safe Materials | Apr. 21, 1998 |
| 5,788,364 | Compact High-Intensity UVA Inspection Lamp | Aug. 4, 1998 |
| 5,959,306 | Portable Light Source And System For Use In Leak Detection | Sep. 28, 1999 |
| 5,975,712 | Telescopic Illuminating Tool | Nov. 2, 1999 |
| 6,200,134 B1 | Apparatus And Method For Curing Materials With Radiation | Mar. 13, 2001 |
| 6,355,935 B1 | Portable Light Source And System For Use In Leak Detection | Mar. 12, 2002 |
| 6,491,408 B1 | Pen-Size LED Inspection Lamp For Detection Of Fluorescent Material | Dec. 10, 2002 |

One of the challenges facing the design of such light source devices is associated with the necessity to direct the light into a restricted area or space. For example, when a mechanic is attempting to repair a vehicle engine and desires to examine somewhat inaccessible portions of an engine or ancillary equipment attached to the engine in order to locate a fluid leak source, the mechanic will need to carefully direct an ultraviolet or infrared light beam. A typical flashlight construction beam may not be easily directed. Additionally, many prior art light constructions are bulky and not easy to manipulate.

Thus, there has developed a need to provide a flashlight construction which utilizes an easily directed light emitting diode light source. Such a construction should preferably rely upon long life, low current batteries of sufficient voltage for a light emitting diode that will produce a highly visible or highly intense beam of light.

SUMMARY OF THE INVENTION

Briefly, the present invention comprises a light emitting diode (LED) light source flashlight construction incorporated in a pen-sized, unitary, plastic housing. The housing is comprised of an elongate, hollow tubular section connected to a disc shaped battery chamber. Internal wiring connects from the battery chamber through the hollow tubular section to a light emitting diode mounted at the end of the hollow tubular section. The circuit is closed whenever a conductive pocket clip affixed externally to the housing is elastically deformed. The flashlight construction utilizes disk shaped, lithium batteries retained in the battery chamber and which produce an adequate voltage to activate a light emitting diode light source to provide an intense, focused beam of light.

Thus, it is an object of the invention to provide an improved light emitting diode (LED) flashlight construction.

A further object of the invention is to provide a flashlight construction which may be utilized with a light emitting diode or with other light sources such as an incandescent bulb.

Yet another object of the invention is to provide a flashlight construction which is compact, yet rugged and easy to use and store when not in use.

Another object of the invention is to provide a flashlight construction which may be utilized in combination with ultraviolet as well as infrared and white light, light emitting diodes.

Another object of the invention is to provide an inexpensive, yet highly reliable, long life flashlight construction.

These and other objects, advantages and features of the invention will be set forth in the detailed description which follows.

BRIEF DESCRITION OF THE DRAWING

In the detailed description which follows, reference will be made to the drawing comprised of the following figures:

FIG. 2A is a cross sectional view taken along the line 2A—2A in FIG. 2;

FIG. 2B is an inside plan view of the battery cover for the housing of the battery in the chamber section of the light construction;

FIG. 2C is a side view of FIG. 2B;

FIG. 2D is an outside plan view of the cover of FIG. 2B;

FIG. 11 is the circuit subassembly incorporated in the flashlight construction of the invention.

DESCRIPTION OF THE PREFERRED EMBODIMENT

Figure 1:
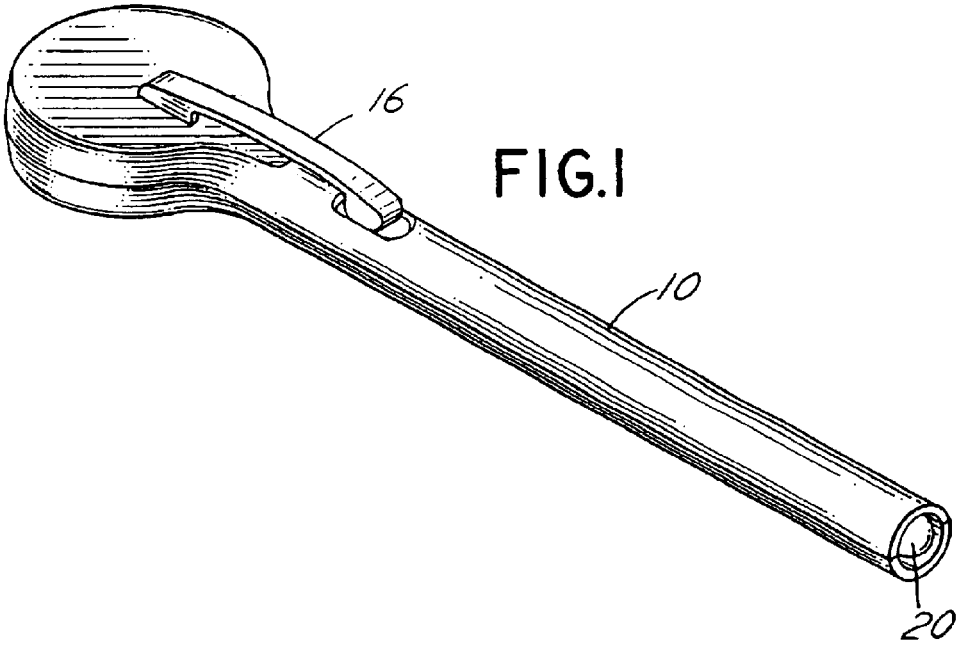
FIG. 1 is an isometric view of the flashlight construction of the invention.
Figure 2:
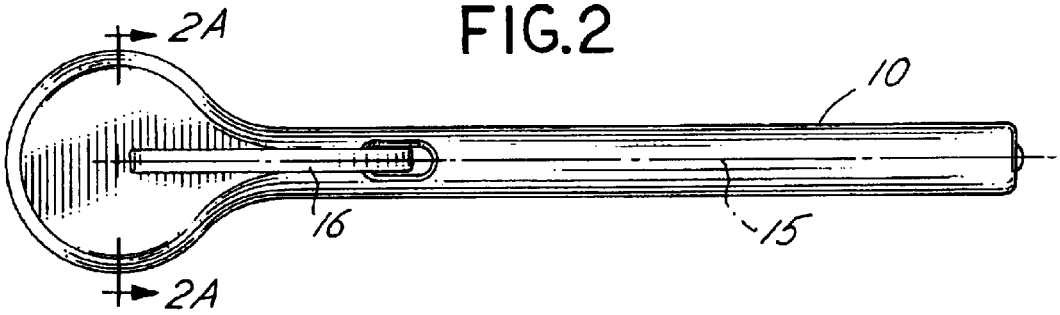
FIG. 2 is a top plan view of the construction of FIG. 1.
Figure 3:
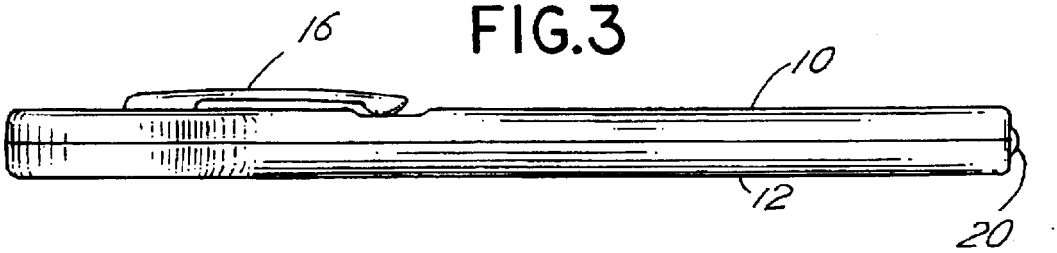
FIG. 3 is a side elevation of the construction of FIG. 2.
Figure 4:
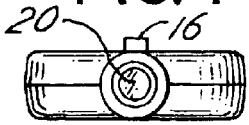
FIG. 4 is an end view of the construction of FIG. 3.
Figure 5:
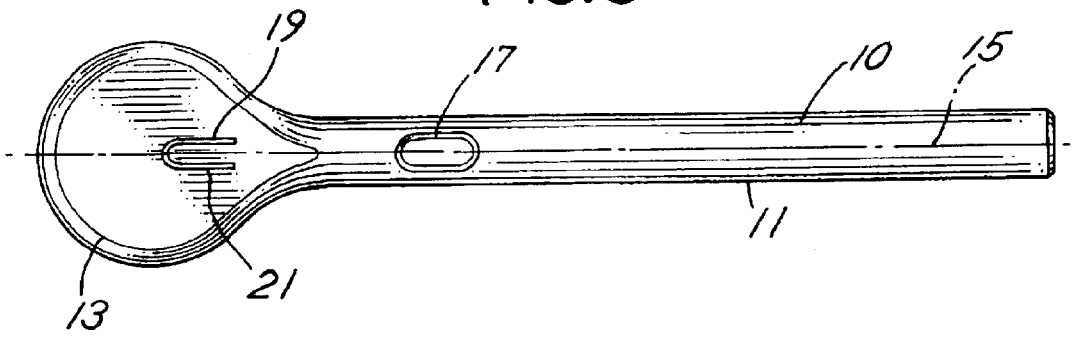
FIG. 5 is a top plan view of the half of the housing utilized in the flashlight construction of the invention.
Figure 6A:
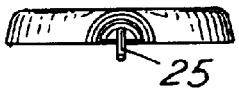
FIG. 6A is an end view of the housing section of FIG. 6.
Figure 6:
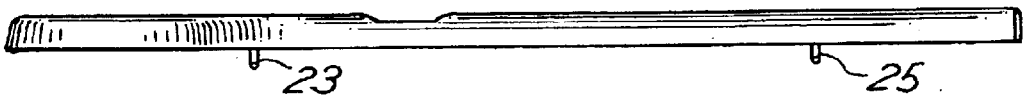
FIG. 6 is a side elevation of FIG. 5.
Figure 7:
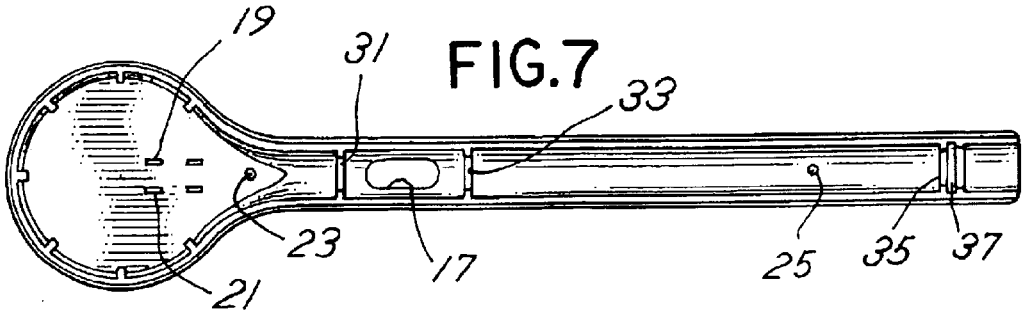
FIG. 7 is a bottom elevation of the construction of FIG. 5.
Figure 9:
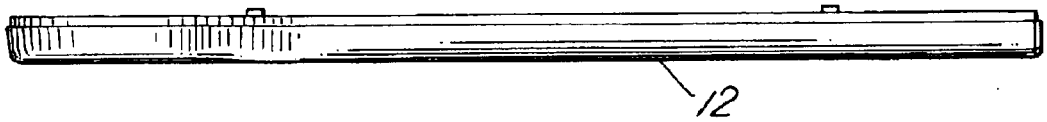
FIG. 9 is a side elevation of FIG. 8.
Figure 9A:
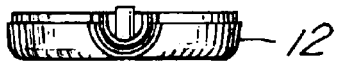
FIG. 9A is an end view of the housing section of FIG. 9.
Figure 8:
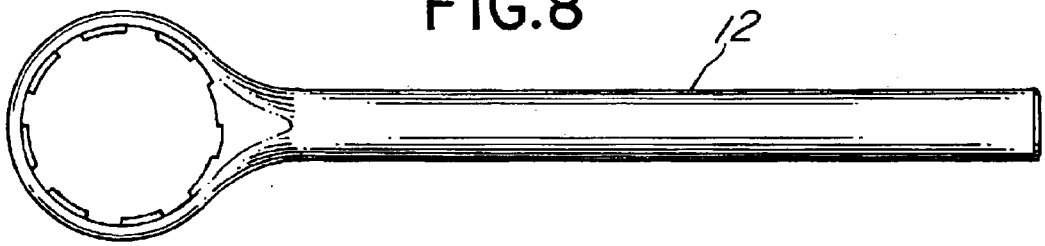
FIG. 8 is a plan view of the bottom portion of the housing of the flashlight construction.
Figure 10:
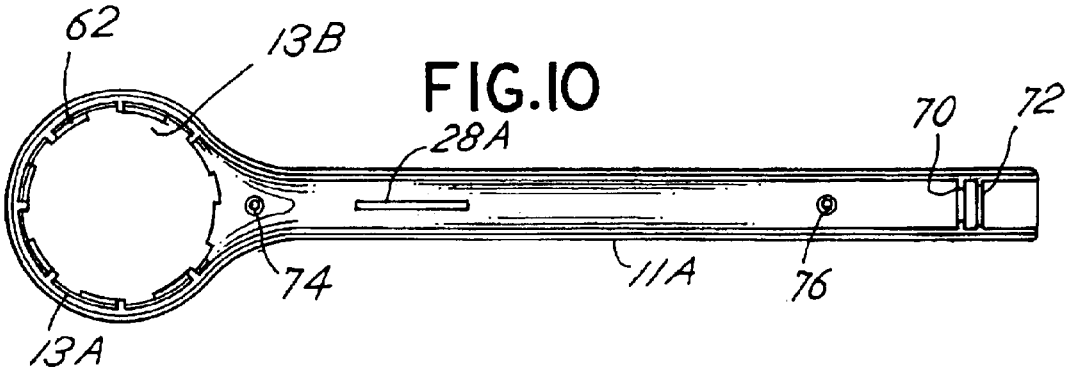
FIG. 10 is a plan view of the inside of the housing of FIG. 8.

General Overview:

Referring to the figures, the flashlight construction of the invention is comprised of three molded plastic component parts; namely, an upper or outside or top housing or housing section 10 depicted in FIGS. 5, 6, 6A and 7; a generally mirror image bottom or inside or lower housing or housing section 12 depicted in FIGS. 8, 9, 9A and 10 and a molded battery cover 14 for the battery chamber section of the joined housings 10, 12 depicted in greater detail in FIGS. 2B, 2C and 2D. The flashlight construction further includes a flexible, elastic, conductive metal clip 16 attached to the outside surface of housing section 10 and projecting through the outer housing section 10 to provide for controlled closure of an electric, direct current series circuit. Contained within the joined housings 10, 12 is a direct current circuit assembly depicted in FIG. 11 including a light emitting diode 20 connected with an insulated cathode wire 22. The cathode wire 22, in turn, is connected with a conductive metal biasing member 24 in contact with series arranged, disc shaped batteries 32, 34. The light emitting diode 20 is further connected with a lead wire anode 26 that is insulated but electrically connected from LED 20 to a cylindrical, conductive metal contact 28. Contact 28 is positioned within the housings 10, 12 for engagement by flexed clip 16 through a passage 17 in housing 10. The circuit assembly of FIG. 11 is retained within the housings 10 and 12 for cooperative action with first and second lithium disc shaped batteries 32 and 34 as well as the metal clip 16.

Thus, the overall construction of the flashlight comprises joinder of the upper or outside housing 10 with the lower or bottom housing 12 to encapsulate the batteries 32, 34 as well as the circuit assembly of FIG. 11. The battery cover 14 retains batteries 32 and 34 within a cylindrical battery chamber section 13 defined by the coupled housings 10 and 12. The metal clip 16 includes prongs 16A which serve the dual function of attachment of the clip 16 to the housing 10 and to provide an electrical conductive path to one of the poles of the disc shaped batteries 32, 34 which are arranged in stacked, series in the chamber section 13 of the coupled housings 10, 12. The metal clip 16 is normally biased so that it does not engage with the cylindrical metal conductor member 28. However, manual engagement of the metal clip 16 will flex and close the circuit through the cylindrical metal section 28 thereby closing the circuit through the batteries 32, 34 and providing electrical current of adequate voltage to the light emitting diode 20 positioned within the coupled housings 10, 12.

Housing Construction:

The coupled housings 10, 12 include a longitudinal, centerline axis 15 which is an axis of symmetry. The longitudinal length of the housings 10, 12 in the direction of the axis 15 is in the range of 4–6 inches in the preferred embodiment. The lateral side-to-side dimension of the housings 10, 12 is in the range of ¾ to 1½ inches. The thickness or transverse dimension of the assembled light construction is in the range of ¼ to ½ inches. As a consequence, the entire assembly may be easily retained within the pocket of a user for ease of access and ease of storage. The conductive metal clip 16 retains the item in a pocket. As a result, the flashlight construction is extremely easy to access.

In the preferred embodiment, the light construction utilizes two 2016 coin cell lithium 3-volt batteries in series. Any of a number of light emitting diodes having various wavelength characteristics may be utilized. For example, an infrared, ultraviolet or white light, light emitting diode may be utilized in the flashlight construction. An incandescent bulb may be utilized. Further, it is possible to color code the molded plastic housings 10 and 12, for example to indicate the wavelength of the light emitting diode. For example, for an ultraviolet flashlight construction, the plastic housing may be molded from a blue plastic material, for example, an ABS plastic material. For an infrared flashlight construction, the molded plastic components may be manufactured from a red ABS plastic material. Other colors may be utilized. However, the color coding system facilitates the functionality of the flashlight construction enabling the user to immediately understand the capability of the flashlight in terms of the wavelength associated with the light emitting diode (LED).

Referring to FIGS. 2B, 2C, 2D, 5, 6, 7, 6A, 8, 9, 9A and 10, there is depicted in greater detail the construction of the component plastic parts which are used to construct the light emitting diode flashlight construction. Referring first to FIGS. 5, 6, 6A and 7, there is depicted the top or outer housing 10. The top or outer housing 10 is symmetric about the longitudinal axis 15 and includes a semi-tubular section 11 connected to an upper chamber section 13. The semi-tubular section 11 comprises a hollow semi-cylindrical section having a longitudinal passage 17 formed therein for cooperation with the cylindrical, conductive member 28 and the LED 20. The chamber section 13 is formed so as to receive the disc shaped batteries 32, 34. The chamber section 13 further includes parallel slits 19 and 21 for receipt of conductive attachment prongs 16A of the metal clip 16. The conductive metal prongs 16A fit through the slits 19 and 21 for engagement with one of the conductive poles; namely, the anode pole of a disc battery 32 or 34 within the cylindrical chamber 13. The outer housing 10 semi-tubular section 11 further includes first and second radially projecting prongs or tabs 23 and 25 which are cooperative with and engage with radial receptors or receptacles associated with the bottom housing 12. In this manner, the housing sections 10 and 12 may be aligned or joined or retained together by ultrasonic welding, for example.

Within the tube section 11 are various transverse wall sections. Thus, a first wall section 31 is positioned on one side of the slot 17. A second wall section 33 is positioned on the other side of slot 17. The wall sections 31, 33 cooperate with the cylindrical conductive member 28 to hold member 28 in position aligned with the tubular passage 17. Spaced third and fourth transverse wall sections 35 and 37 at the outer end of the tube section 11 cooperate with a peripheral rib 39 in FIG. 11 of the light emitting diode 20 to retain the light emitting diode in position within the tube 11.

FIGS. 8, 9, 9A and 10 depict the bottom or inside housing 12. The bottom or inside housing 12 is, in general, a mirror image of the outer housing 10. The bottom housing 12 thus includes a semi-tubular section 11A and chamber section 13A. The chamber section 13A, however, is open and includes a notched periphery 13B for receipt of battery cover 14 having compatible notches and teeth. The battery cover 14 is depicted in FIGS. 2B, 2C and 2D and comprises a molded flat plastic member with radially projecting teeth 60 that cooperate with notches 62 in periphery 13B. The inside face of the battery cover 14 includes a central rib 64 that provides for molding a slot or recess in the outside of cover 14. The outside of the cover 14 includes slot 66 in FIG. 2D which can receive a coin or some other item to effect turning and locking of the cover 14 in position within the notches 62 of the bottom housing 12.

Referring again to FIGS. 8, 9, 9A and 10, the bottom housing 12 also includes transverse walls or wall sections 70 and 72 cooperative with the external rib 39 on the light emitting diode 20. The bottom section 12 further includes, on the inside thereof, receptacles 74 and 76 for cooperation respectively with the projecting tabs 23 and 25 of the top housing 10 so that the component housings 10, 12 may be aligned for joinder by adhesive, or sonic welding, or other means. Further, the interior of the bottom section 12 includes a longitudinal rib 28A that serves as a key to engage and retain the conductive member 28 by fitting into a longitudinal slot 28B in the member 28.

Figure 12:
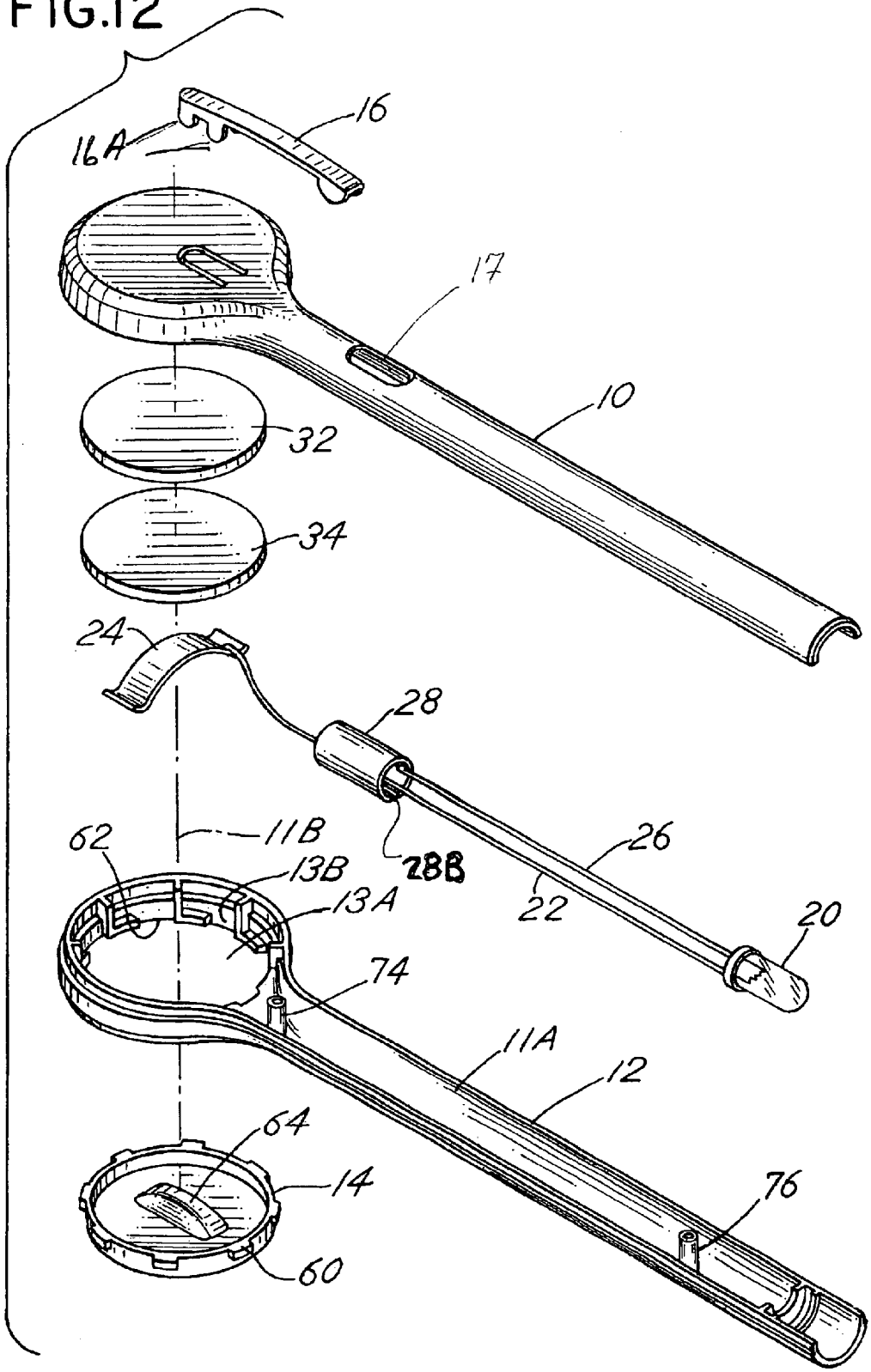
FIG. 12 is a an exploded isometric view of the flashlight construction of the invention.

Referring to FIG. 12, the battery chamber or battery section 13A of the housings 10, 12 comprises a generally cylindrical chamber having a cylindrical axis 11B that is transverse to the longitudinal axis 15. The longitudinal axis 15 thus comprises a cylindrical axis for the tubular section 11 of the housings. Axis 11B defines a cylindrical axis for the chamber section 13B. The axes 11B and 15 are generally normal to each other.

The cross sectional configuration of the tubular section is generally cylindrical but may be polygonal or comprise other shapes. Likewise, the battery chamber may have various shapes or configurations other than cylindrical.

Thus, it is possible to vary the shape and arrangement of the various component parts comprising the flashlight construction without departing from the spirit and scope of the invention. The invention, therefore, is limited only by the following claims and equivalents thereof.

What is claimed is:

1. A flashlight construction comprising, in combination:

a molded plastic housing comprised of first and second generally mirror image sections, said sections fitted together to form said housing, said housing having a top end, a bottom end, a light emitting opening at the bottom end and a longitudinal, centerline axis extending from the top end to the bottom end, said housing including a disc shaped battery chamber section at the top end with an internal disc shaped chamber, and an elongate projecting hollow tube section joined to said disc shaped battery chamber section;

said chamber section having a centerline axis forming an angle with a centerline axis of the hollow tube section, said chamber section including a first, generally planar side with a removable cover for the battery chamber and an opposed non-conductive, integral, generally planar clip support side;

a bulb mounted in the hollow tube section at the light emitting opening of the bottom end;

a disc shaped battery having a first pole and a second pole, said battery located in the disc shaped chamber of the chamber section and having a first electrical conductor connection from said first pole to the bulb; and a circuit assembly including a conductive pocket clip member longitudinally fixed to the outside of the clip support side of the chamber section of the housing, said pocket clip member including conductive prongs extending through the support surface to electrically connect to the second pole of the battery in said battery chamber and to retain the pocket clip member longitudinally fixed to the chamber section, said hollow tube section including a passage therethrough aligned with the clip member, a second circuit conductor inside the hollow tube also aligned with the passage, said clip member connectable by elastic flexing to engage said second circuit conductor and thereby electrically connect to the bulb in the hollow tube section by projecting through said passage in the hollow tube section to complete a circuit with the battery, said pocket clip formed from an elastic, conductive material and normally disengaged from the second circuit conductor and flexed to engage the second circuit conductor.

2. The construction of claim 1 wherein the diameter of the tube is in the range of ⅛ to ⅜ inch.

3. The construction of claim 1 wherein the bulb member is selected from the group consisting of an IR LED bulb, a UV LED bulb, and a white light LED bulb.

4. The construction of claim 1 wherein the first conductor comprises at least one conductive spring member positioned in the battery chamber intermediate the cover and the battery for connection to the battery in the battery chamber and for biasing the battery to electrically contact the prongs of the flexible clip.

5. The construction of claim 1 including a plurality of disc shaped batteries in series in the chamber section.

6. The construction of claim 1 wherein the second conductor comprises a conductive, generally cylindrical plate in the hollow tube section aligned longitudinally with the passage through the hollow tube section.

7. The construction of claim 1 wherein the housing first and second generally mirror image sections include a hollow elongate tube section extending from said disc shaped chamber section and wherein the hollow tube section has an elongate axis generally normal to said chamber section axis.

8. The construction of claim 7 wherein the disc chamber is generally cylindrical and the hollow tube section is at least three times as long as the diameter of the disc chamber section.

9. The construction of claim 6 wherein the plate includes an elongate, generally axial slot and the inside of the hollow tube section includes a rib for engaging the plate slot to retain the plate aligned in the hollow tube section.

10. The construction of claim 7 including opposed tabs and receptacles engageable for alignment and attachment of the sections together.

11. The construction of claim 1 including first and second wall sections within the hollow tube for retaining the second circuit conductor in alignment with the passage of the hollow tube section.

12. A flashlight construction comprising, in combination:

a first molded plastic housing section, said first housing section including an elongate, hollow tubular section and a connected disc battery chamber section joined to the tubular section, said tubular section comprised of a generally semi-cylindrical tube, said battery chamber section comprised of a disc shaped battery chamber connected to the tubular section, a second molded plastic housing section comprising a generally mirror image of the first housing section, said first and second sections joined to form a housing for at least one disc shaped battery in the chamber formed by the battery chamber sections, said battery chamber sections connected to a hollow tube formed by the tubular sections, said hollow tube including an open end, and a passage through a side wall of said tube;

an LED bulb in the hollow tube at the open end;

a disc shaped battery in the battery chamber having a first pole and a second pole;

a first lead in the housing from the LED bulb electrically connected to the first pole of the battery;

a second lead in the housing connected to a generally cylindrical, conductive contact in the hollow tube retained in fixed, non-moveable longitudinal alignment with the passage; and a flexible, conductive pocket clip fixed by prongs to the chamber section of said first housing section, said prongs electrically connected to said second pole of the battery, said clip including a contact end aligned with the passage, said clip being elastically deformable to electrically contact the generally cylindrical, conductive contact by extending through the passage, the inside of said hollow tube including wall sections for maintaining the generally cylindrical, conductive contact non-moveable and fixed in longitudinal alignment with the passage.

13. The construction of claim 12 wherein the hollow tube includes a wall adjacent each side of the passage to maintain the generally cylindrical, conductive contact aligned with the passage.

14. The construction of claim 12 wherein the generally cylindrical, conductive contact and hollow tube include engagement elements for maintaining the generally cylindrical, conductive contact in alignment in the hollow tube.

15. The construction of claim 14 wherein the engagement elements comprise a slot in the generally cylindrical, conductive contact a rib on the inside of the hollow tube to engage the slot.

16. The construction of claim 13 wherein the battery chamber section of the second housing includes a removable cover.

* * * * *